United States Patent [19]

Tahara et al.

[11] Patent Number: 4,889,507

[45] Date of Patent: Dec. 26, 1989

[54] OUTBOARD PROPULSION UNIT SUPPORTING SYSTEM

[75] Inventors: Hideo Tahara; Novuo Makihara; Hiroshi Ono, all of Yokosuka, Japan

[73] Assignee: Nissan Motor Co., Ltd., Yokohama, Japan

[21] Appl. No.: 129,551

[22] Filed: Dec. 7, 1987

[30] Foreign Application Priority Data

Oct. 13, 1987 [JP] Japan ..... 62-257514

[51] Int. Cl.[4] ..... B63H 21/26

[52] U.S. Cl. ..... 440/61; 248/641

[58] Field of Search ..... 440/61, 58–60, 440/62, 63; 248/640–642

[56] References Cited

U.S. PATENT DOCUMENTS

| | | | |
|---|---|---|---|
| 2,928,630 | 3/1960 | Wisman | 248/641 |
| 3,809,343 | 5/1974 | Adams et al. | 248/642 |
| 3,983,835 | 10/1976 | Hall | 440/61 |
| 4,143,614 | 3/1979 | Jeanson et al. | 440/61 |
| 4,657,513 | 4/1987 | Baker | 440/66 |

FOREIGN PATENT DOCUMENTS

| | | |
|---|---|---|
| 61-12497 | 1/1986 | Japan . |
| 62-205895 | 9/1987 | Japan . |

*Primary Examiner*—Sherman D. Basinger

*Attorney, Agent, or Firm*—Foley & Lardner, Schwartz, Jeffery, Schwaab, Mack, Blumenthal & Evans

[57] ABSTRACT

An outboard propulsion unit supporting system by which an outboard propulsion unit is vertically movably supported to the rear end section of a boat. The supporting system is comprised of a pair of slit brackets installed to the rear end section of the boat. Each slit bracket is formed with a generally vertically extending slit in which a guide roller rotatably secured to the side of the propulsion unit is movably engaged. The boat is provided at its transom with a pair of thrust rollers on which a pair of generally vertically extending guide rails formed on the propulsion unit side are detachably contact, respectively. Additionally, a tilt cylinder is provided between the boat transom and the propulsion unit side thereby to raise the propulsion unit generally vertically.

19 Claims, 8 Drawing Sheets

OUTBOARD PROPULSION UNIT SUPPORTING SYSTEM

BACKGROUND OF THE INVENTION

1. Field of the Invention

This invention relates to a supporting system for supporting an outboard propulsion unit to a boat, and more particularly to such an outboard propulsion unit supporting system for allowing the propulsion unit to be displaced vertically and tilted relative to the boat.

2. Description of the Prior Art

Hitherto smaller ships and boats are provided at their transom with an outboard propulsion unit thereby to generate propulsion force. Now it has been proposed and put into practical use to provide a device which causes the propulsion unit to be displaced upwardly and downwardly and tilted relative to the boat, in which a propeller is installed at the lower end of the boat. With such a device, for example during cruising on the shoal, the propulsion unit with the propeller is raised upwardly thereby preventing the propeller from breakage due to interference with rock and reef. Additionally, the propulsion unit with the propeller is controllably displaced upwardly or downwardly to obtain the maximum thrust during cruising. Such a mechanism for displacing the location of the propeller upwardly and downwardly is disclosed, for example, in Japanese Patent Provisional Publication No. 61-12497, in which a boat side member and a propulsion unit side member are connected with each other by upper and lower links to constitute a generally rectangular link mechanism. The angle of the upper and lower links relative to a boat transom is changed by a lift cylinder, thereby displacing the propulsion unit upwardly or downwardly relative to the boat.

However, with the arrangement of the Japanese Patent Provisional Publication, the distance between the boat transom and the outboard propulsion unit changes with upward and downward displacement of the propulsion unit since the propulsion unit is supported to the boat transom through the rectangular link mechanism. By the way, there is a fear of generating water spray to be sprinkled over the boat owing to impingement of water flow from the boat rear section against the outboard propulsion unit during cruising, because the outboard propulsion unit is supported rearwardly separate from the boat transom. Hitherto in order to prevent this water spray generation, various measures have been taken in which the front side of the propulsion unit is formed into the particular shape to suppress generation of water spray; however, such measures are usually made to be the most effective at a certain fixed distance between the boat transom and the propulsion unit. As a result, the above-mentioned change in the distance between the boat transom and the propulsion unit causes adjustment to get out of order thereby allowing sprashed water to be sprinkled over the boat. Furthermore, since the propulsion unit has a larger weight, change of the position of the propulsion unit relative to the boat causes the center of the gravity to be displaced, thereby resulting in trimming change.

SUMMARY OF THE INVENTION

An outboard propulsion unit supporting system of the present invention is comprised of an upper supporting mechanism by which an outboard propulsion unit is supported to a boat. The upper supporting mechanism includes a structure formed with a slit extending generally vertically and having upper and lower terminals. The structure is secured to one of boat side and propulsion unit side. A movable member secured to the other of the boat and propulsion unit sides is engaged in the slit and movable between the upper and lower terminals. A lower supporting mechanism is provided to support the propulsion unit to the boat and includes a structure forming a guide rail extending generally vertically. The structure is secured to one of the boat and propulsion unit sides. A support member secured to the other of the boat and propulsion unit sides is detachably contactable with the guide rail and movable along the guide rail. Additionally, a hydraulic cylinder is provided to displace the propulsion unit relative to the boat and has a lower end section pivotally connected to the boat and a upper end section pivotally connected to the propulsion unit side, in which the upper end section is positioned rear relative to the lower end section.

Accordingly, by virtue of the fact that both the slit and the guide rail extend vertically, the propulsion unit can be displaced vertically relative to the boat, thereby enabling the distance between the boat and the propulsion unit to be maintained generally constant on the surface of the water even if the propulsion unit is displaced upwardly or downwardly. As a result, it is sufficient that adjustment of the front side shape of the propulsion unit and the inclination of the boat transom is carried out only in forward cruising state in order to prevent impinging water against the propulsion unit from being splashed into the boat. Accordingly, water splashing into the boat is largely suppressed or avoided even when the propulsion unit is displaced upwardly and downwardly. Additionally, such vertical displacement of the propulsion unit prevents the center of the gravity from moving, thereby avoiding trimming change.

BRIEF DESCRIPTION OF THE DRAWINGS

In the figures, like reference numerals and characters designate like parts and elements, in which.

DETAILED DESCRIPTION OF THE INVENTION

Figure 1:
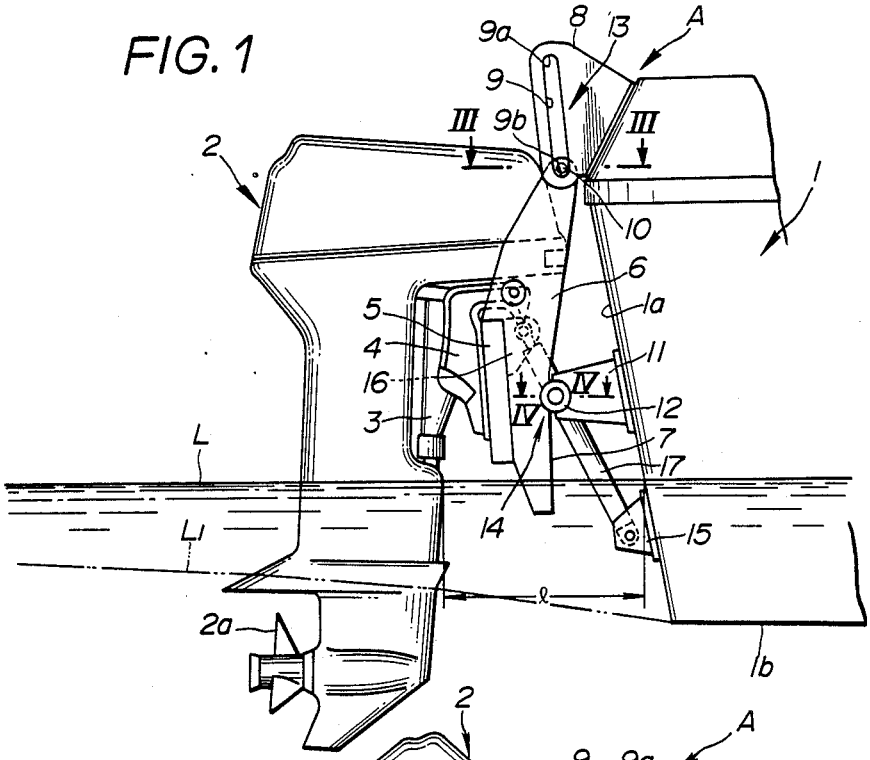
FIG. 1 is a side elevation of a first embodiment of an outboard propulsion unit supporting system in accordance with the present invention.
Figure 2:
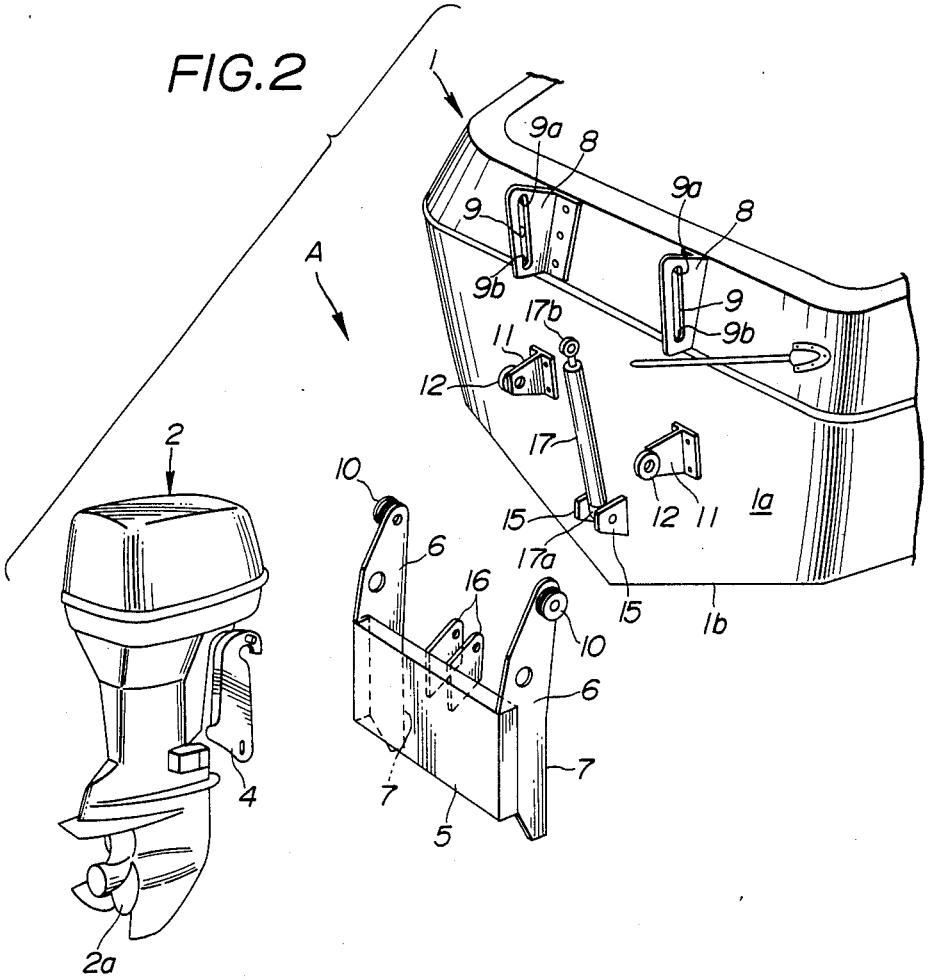
FIG. 2 is an exploded perspective view of the supporting system of FIG. 1.

Referring now to FIGS. 1 and 2, there is shown a first embodiment of an outboard propulsion unit supporting system A by which an outboard propulsion unit 2 is supported onto a boat 1. The outboard propulsion unit 2 includes a power head having an engine (not identified). The engine drives a propeller 2*a* disposed at the lower section of the propulsion unit 2. The lower section of the propulsion unit 2 also serves as a rudder. A support bracket 3 is installed through a swivel bracket 3 and a clamp bracket 4 to the propulsion unit 2 and located on the front side of the propulsion unit 2, i.e., on the side of the boat 1. The support bracket 5 is generally plate-shaped and disposed vertically in such a manner that the extension of the axis of the propeller 2*a* is perpendicular to the support bracket 5. The support bracket 5 laterally extends and has opposite end sections to which a pair of arm brackets 6, 6 are fixedly secured, respectively. Each arm bracket 6 extends generally vertically and such disposed as to be perpendicular to the support bracket 5. Each arm bracket 6 is formed at its front side with guide rail 7 which extends generally vertically. A guide roller 10 is rotatably secured to the upper end section of each arm bracket 6 at the outside surface. More specifically, the roller 10 is rotatably mounted on a shaft (no numeral) fixed to the arm bracket 6.

Figure 3:
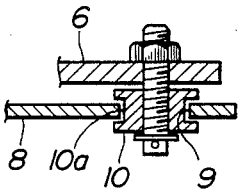
FIG. 3 is a fragmentary sectional view taken in the direction of arrows substantially along the line III—III of FIG. 1.

A pair of slit brackets 8, 8 are fixedly installed to the upper portion of the rear end section of the boat 1, i.e., above a boat transom 1*a*. The slit brackets 8, 8 are located on the opposite sides of a vertical plane (not identified) containing a longitudinal axis of the boat 1, and projects rearwardly toward the propulsion unit 2. Each slit bracket 8 extends generally vertically and disposed parallel with the above-mentioned vertical plane. Each slit bracket 8 is formed with a slit 9 which generally vertically extends and accordingly is generally parallel with the guide rail 7 of the arm bracket 6. The slit 9 has upper and lower terminals 9*a*, 9*b*. As shown in FIG. 3, the guide roller 10 is rotatably fitted in the slit 9 in such a manner that the inner periphery of the slit bracket 8 defining the slit 9 engages in a central annular groove 10*a* of the guide roller 10. Accordingly, the guide roller 10 is movable vertically between the slit upper and lower terminals 9*a*, 9*b*.

Figure 4:
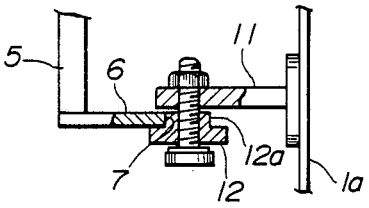
FIG. 4 is a fragmentary sectional view taken in the direction of arrows substantially along the line of IV—IV of FIG. 1.

A pair of thrust receiving brackets 11, 11 are fixedly installed to the outer surface of the boat transom 1*a* at the rear end section of the boat 1 and positioned on the opposite sides of the above-mentioned vertical plane of the boat 1. Each thrust receiving bracket 11 projects rearwardly toward the propulsion unit 2 and is provided at its tip end section with a rotatable thrust roller 12 in such a manner that the thrust roller 12 is rotatably mounted on a shaft (no numeral) fixed to the bracket 11. The thrust roller 12 is being brought into engagement with the guide rail 7 of the arm bracket 6 as shown in FIG. 4. More specifically, the thrust roller 12 detachably engages at its small diameter section 12*a* with the arm bracket guide rail 7. Accordingly, the guide rail 7 is vertically movable upon contacting with the thrust roller 12. Thus, the slit brackets 8, 8 and the guide rollers 10, 10 constitute an upper supporting mechanism 13, while the guide rails 7, 7 and the thrust rollers 12, 12 constitute a lower supporting mechanism 14.

A pair of lower brackets 15, 15 are fixedly provided on the boat transom 1*a* and located generally below the thrust recieving brackets 11, 11. A tilt cylinder or hydraulic cylinder 17 is provided in such a manner that its lower end 17*a* is pivotally secured between the lower brackets 15, 15 while its upper end 17*b* is pivotally secured between a pair of upper brackets 16, 16 fixed to the central part of the support bracket 5. The lower end 17*a* forms part of the outer cylinder of the tilt cylinder, while the upper end 17*b* forms part of a piston rod of the same. The tilt cylinder 17 is obliquely arranged to obliquely push up and down the support bracket 5 under control of hydraulic fluid to be supplied to or discharged from two fluid chambers of the tilt cylinder 17 which fluid chambers are formed on the opposite sides of a piston 45 secured to the piston rod. It is to be noted that the piston of the tilt cylinder 17 is provided with a relief valve 50 which is arranged to open so as to establish fluid communication between the above-mentioned two fluid chambers when a load over a predetermined level is applied to the tilt cylinder in such a direction that the tilt cylinder 17 extends (the piston rod projects out of the outer cylinder). In FIG. 1, the character L designates the surface of the water, and $L_1$ the surface of wave generated by the boat 1.

The manner of operation of the thus configurated outboard propulsion unit supporting system A will be discussed hereinafter with reference to a variety of modes of the boat 1.

(1) Stopping:

As shown in FIG. 1, the propulsion unit 2 is descending with the arm brackets 6, 6 by its own weight, so that the guide rollers are brought into engagement with the lower terminals 9*b*, 9*b* of the slits 9, 9, respectively. In this state, the propulsion unit 2 seems to be rotated around the guide rollers 10, 10 in the counterclockwise direction by its own weight; however, the thus generated rotational force of the propulsion unit 2 is supported upon the guide rails 7 being brought into contact with the thrust rollers 12, 12.

(2) Forward Cruising:

When the outboard propulsion unit 2 is driven so that the propeller 2*a* generates thrust, reaction of this thrust acts on the lower section of the propulsion unit 2 so that counterclockwise rotational force is applied to the propulsion unit 2 like in the above-mentioned stopping state. This rotational force is received by the guide rails 7, 7 and the thrust rollers 12, 12, thereby enabling the boat 1 to cruise forward.

(3) Backward Cruising:

When the propeller 2*a* is reversely rotated to generate impellent force in direction of backward cruising, clockwise rotational force is applied to the propulsion unit 2 under reaction of the impellent force. Although this rotational force acts onto the propulsion unit 2 in such a direction that the guide rails 7, 7 become separate from the thrust rollers 12, 12, the tilt cylinder 17 prevents the propulsion unit 2 from rotating in such a direction, thereby avoiding ascending movement of the propeller 2*a*. This enables the boat to cruise backward. It is to be noted that the above-mentioned relief valve of the tilt cylinder 17 is adapted not to open under the reaction of the impellent force during backward cruising.

Figure 5:
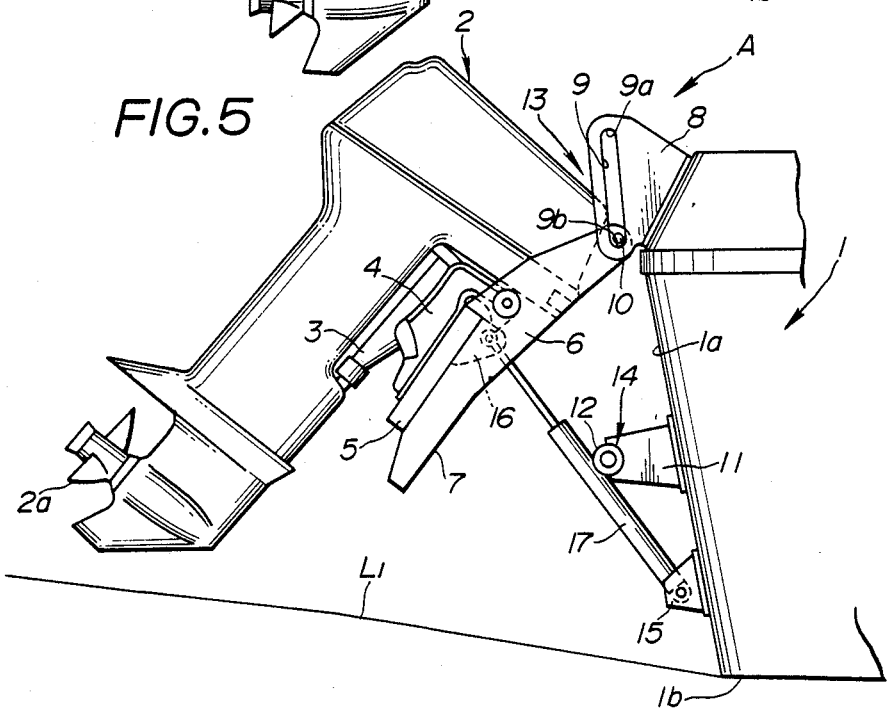
FIGS. 5 to 7 are side elevations similar to FIG. 1 but showing various operational states of the supporting system of FIG. 1.

(4) Kickup:

When a driftwood or the like strikes against the lower section front of the propulsion unit 2 during forward cruising, a larger clockwise rotational force acts on the propulsion unit 2, so that load over the predetermined level is applied to the tilt cylinder 17 in the direction of extension of the tilt cylinder. The predetermined level load is larger than the restriction force of the tilt cylinder 17 during backward cruising. Accordingly, the relief valve of the piston of the tilt cylinder 17 momentarily opens, and therefore the propulsion unit 2 is largely rotated clockwise around the guide rollers 10, 10 engaged with the lower terminal 9*b* of the slit 9, with extension of the tilt cylinder 17 thereby accomplishing kickup action of the propulsion unit 2 as shown in FIG. 5. This kickup action prevents severe interference of the driftwood to the propulsion unit 2. After this, the weight of the propulsion unit 2 causes the tilt cylinder 17 to gradually contract, thereby restoring the propulsion unit 2 into a previous state in the forward cruising. Additionally, since the guide rollers 10, 10 around which the propulsion unit 2 rotates are located at the upper section front of the propulsion unit 2, the propulsion unit 2 can be prevented from largely projecting into the boat 1, so that a conventionally used motor well can be omitted thereby enlarging the effective space within the boat 1.

(5) Cruising on Shoal

Figure 6:
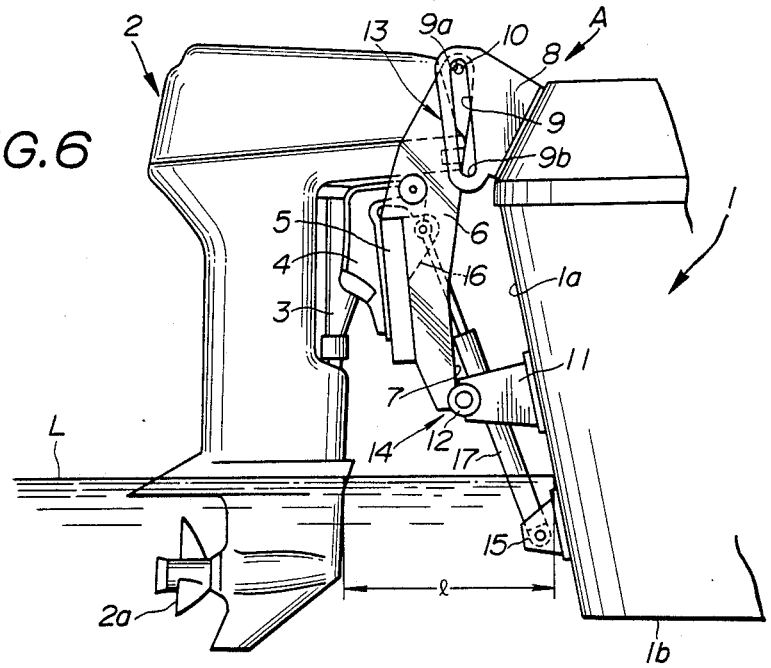

Although the propeller 2*a* of the propulsion unit 2 is usually positioned below the bottom of the boat 1, the tilt cylinder 16 is operated to be extended, for example, during cruising on the shoal or on the hazardous area of the sea in which there are lock and reef, as shown in FIG. 6. Accordingly, the guide rollers 10, 10 and the guide rails 7, 7 move upwardly respectively along the slits 9, 9 and the thrust rollers 12, 12 together with the propulsion unit 2, thus raising the propeller 2*a*. As a result, the propeller 2*a* is prevented from being broken upon interference with the shoal, lock or the like, thereby avoiding disabling of cruising.

During such upward movement of the propulsion unit 2, the propulsion unit 2 can be raised generally vertically without inclination because the slits 9, 9 and the guide rails 7, 7 are formed generally vertical and parallel with each other. Consequently, the distance l between the propulsion unit 2 and the boat transom 1*a* on the surface L of the water in the propulsion unit raised state in FIG. 6 is generally the equal to that in the propulsion unit lowered state in FIG. 1, so that sprashed condition of water impinging against the propulsion unit 2 is generally the same in both the raised and lowered states of the propulsion unit 2, As a result, if adjustment of the distance l is made to prevent water from being splashed into the boat 1 during normal forward cruising, such water splashing can be effectively prevented even during cruising on the shoal. Furthermore, the vertical movement of the propulsion unit 2 relative to the boat 1 prevents the location of center of the gravity of the boat 1 with the propulsion unit 2 from largely changing in the fore-and-aft direction, thereby avoiding trimming change.

While the propulsion unit 2 has been shown as having been raised to its upper-most position in FIG. 6, the amount of upward movement of the propulsion unit 2 can be adjusted in accordance with the extension amount of the tilt cylinder 17 so as to select a suitable position of the propulsion unit 2 in the vertical direction. Such selection of the vertical position of the propulsion unit 2 enables the maximum thrust of the propeller 2*a* to being generated even during normal forward cruising.

Figure 7:
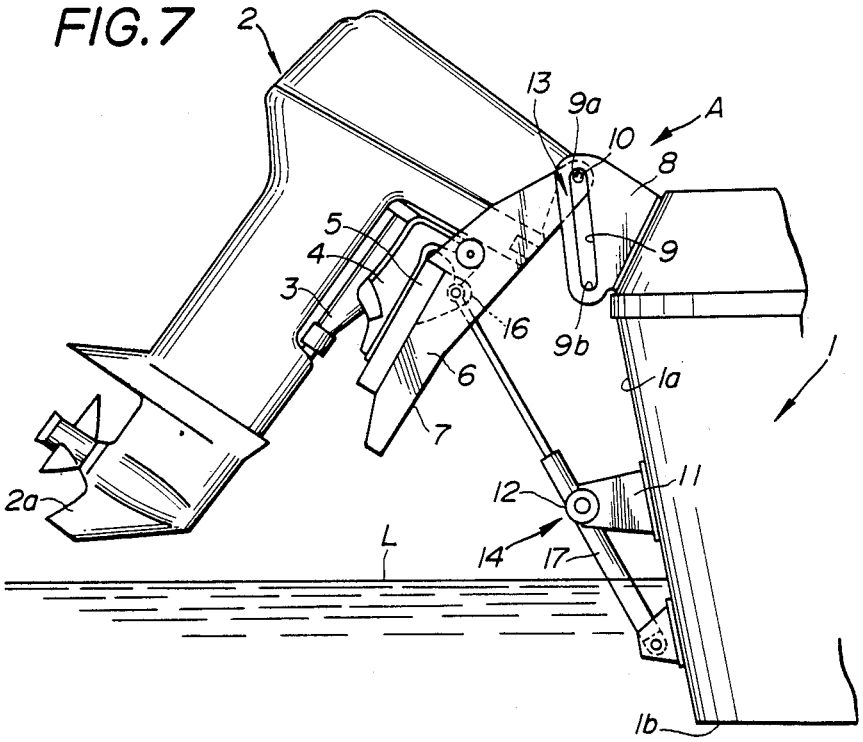

(6) Tilt-up:

In case of landing and anchoring the boat for a long period of time, it is necessary to raise or tilt up the whole propulsion unit 2 over the surface L of the water. For this purpose, the tilt cylinder 17 is operated to be extended so as to raise the propulsion unit 2 to the upper-most position as shown in FIG. 6 and then further extended so as to put the propulsion unit 2 into its position as shown in FIG. 7 in which the propulsion unit 2 is rotated clockwise around the guide rollers 10, 10 in a state the guide rollers 10, 10 have been brought into engagement with the upper terminals 9*a*, 9*a* of the slits 9, 9. Thus, the propeller 2*a* of the propulsion unit 2 is raised over the surface L of the water. Moreover, even during such tilt-up of the propulsion unit 2, the upper end section of the propulsion unit 2 is prevented from projecting into the boat 1 since the propulsion unit 2 is rotated around the guide rollers 10, 10.

Figure 8:
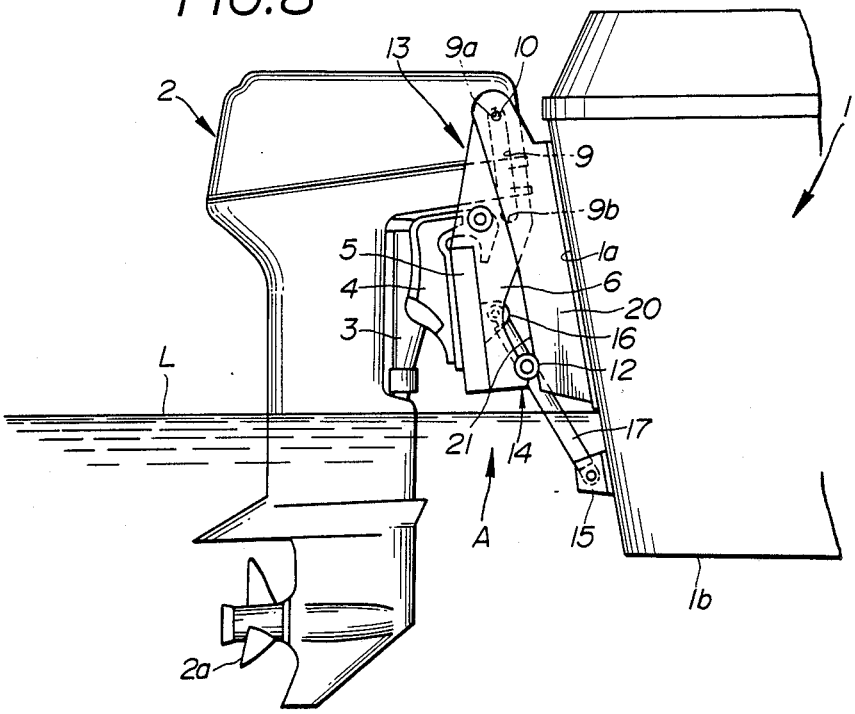
FIG. 8 is a side elevation of a second embodiment of the outboard propulsion unit supporting system in accordance with the present invention.
Figure 9:
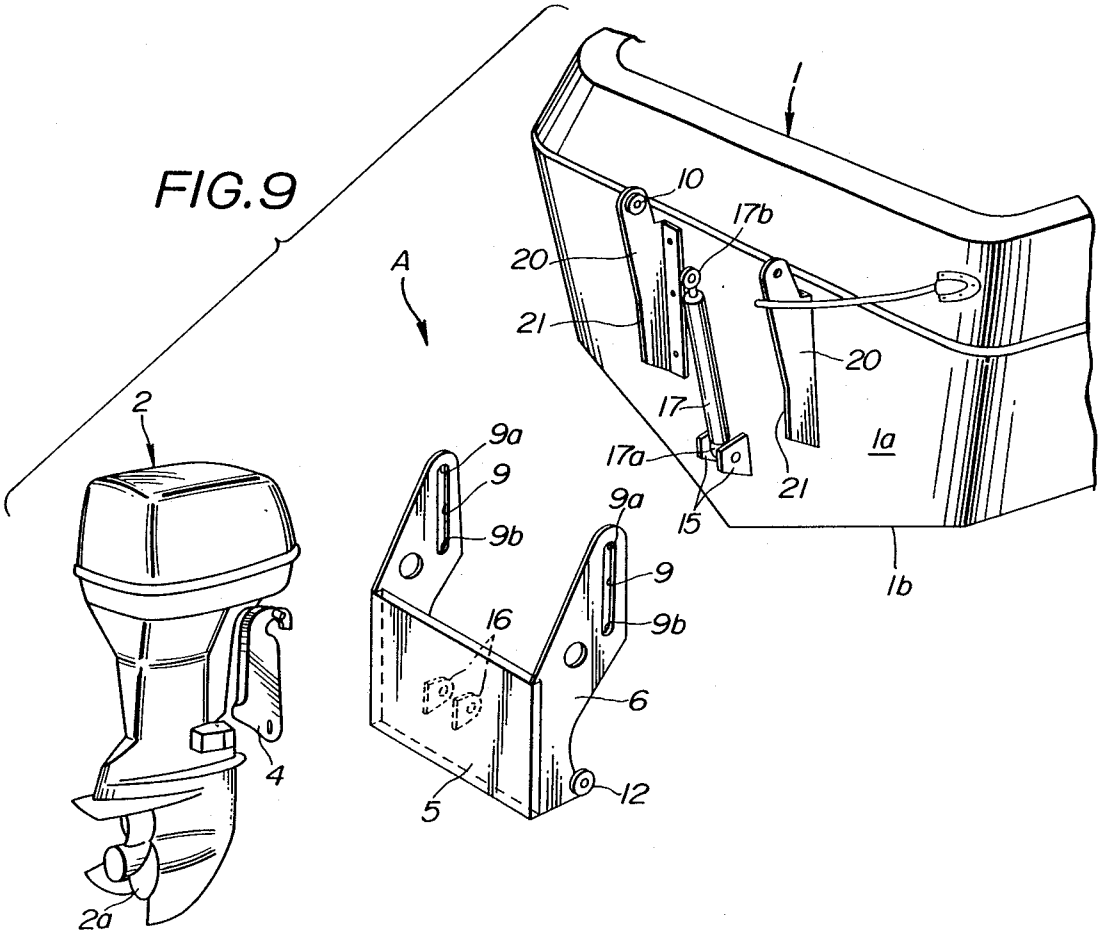
FIG. 9 is an exploded perspective view of the supporting system of FIG. 8.

FIGS. 8 and 9 illustrate a second embodiment of the outboard propulsion unit supporting system A in accordance with the present invention, similar to the first embodiment of FIGS. 1 and 2. In this embodiment, a pair of transom brackets 20, 20 are rigidly installed to the boat transom 1*a* and positioned to be opposite to each other with respect to the vertical plane containing the longitudinal axis of the boat 1. Each transom bracket 20 projects rearwardly toward the propulsion unit 2 and extends generally vertically, and provided at its upper end section with a rotatable guide roller 10. More specifically, the guide roller 10 is rotatably mounted on a shaft (no numeral) projected from the inner surface of the transom bracket 20. Additionally, each transom bracket 20 is formed at its rear vertical edge with the guide rail 21 which generally vertically extends. Each arm bracket 6 secured to the support bracket 5 for the propulsion unit 2 is formed at its upper section with the slit 9 having the upper and lower terminals 9*a*, 9*b*. The guide rollers 10, 10 are in rotatable and movable engagement with the slits 9, 9, respectively. It will be seen that the slits 9, 9 are formed to generally vertically extend. Each arm bracket 6 is provided at its lower end section with the rotatable thrust roller 12. More specifically, the thrust roller 12 is rotatably mounted on a shaft (no numeral) projected from the outside surface of the arm bracket 6. Each thrust roller 12 is detachably contacted with the guide rail 21 formed in each transom bracket 21 in such a manner as to be movable generally vertically along the guide rail 21.

With the thus arranged outboard propulsion unit supporting system A of the second embodiment, the propulsion unit 2 moves vertically together with the arm brackets 6, 6 with the slits 9 and the thrust rollers 12, 12. During stopping of the boat 1, the guide rollers 10 are brought into engagement with the upper terminals 9*a*, 9*a* of the slits 9, 9, respectively, as shown in FIG. 8. During forward cruising of the boat 1, the thrust rollers 12, 12 are brought into press contact with the guide rails 21, 21, respectively, like in the first embodiment. During rearward cruising of the boat 1, the propulsion unit 2 is prevented from clockwise rotation by restraining force of the tilt cylinder 17.

Figure 10:
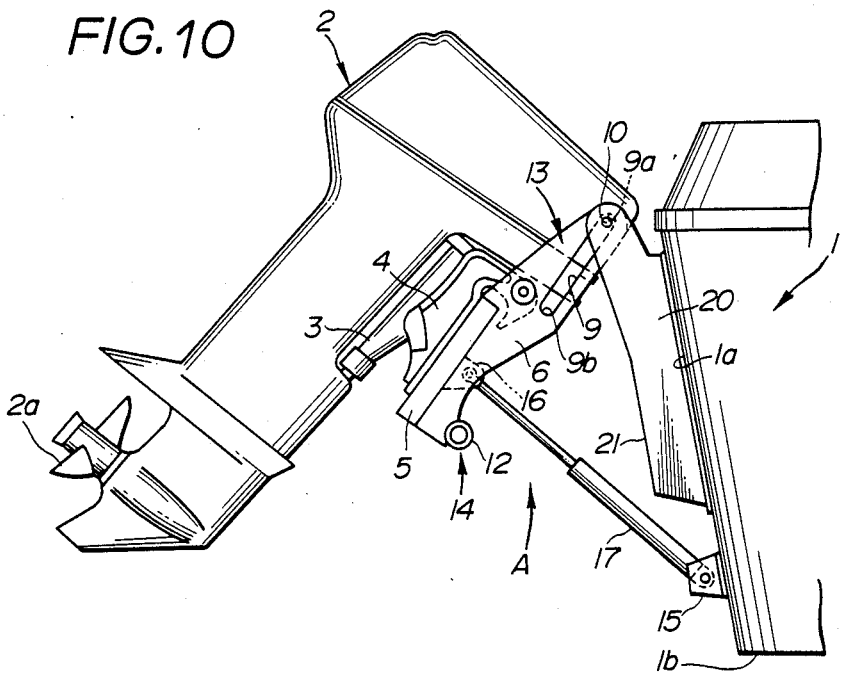
FIGS. 10 to 12 are side elevations similar to FIG. 8 but showing various operational states of the supporting system of FIG. 8.
Figure 11:
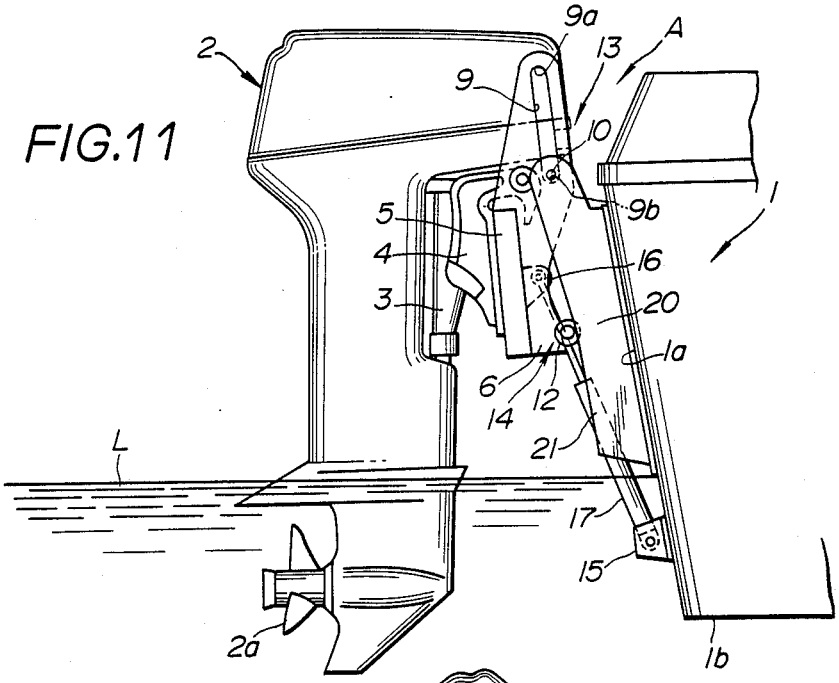
Figure 12:
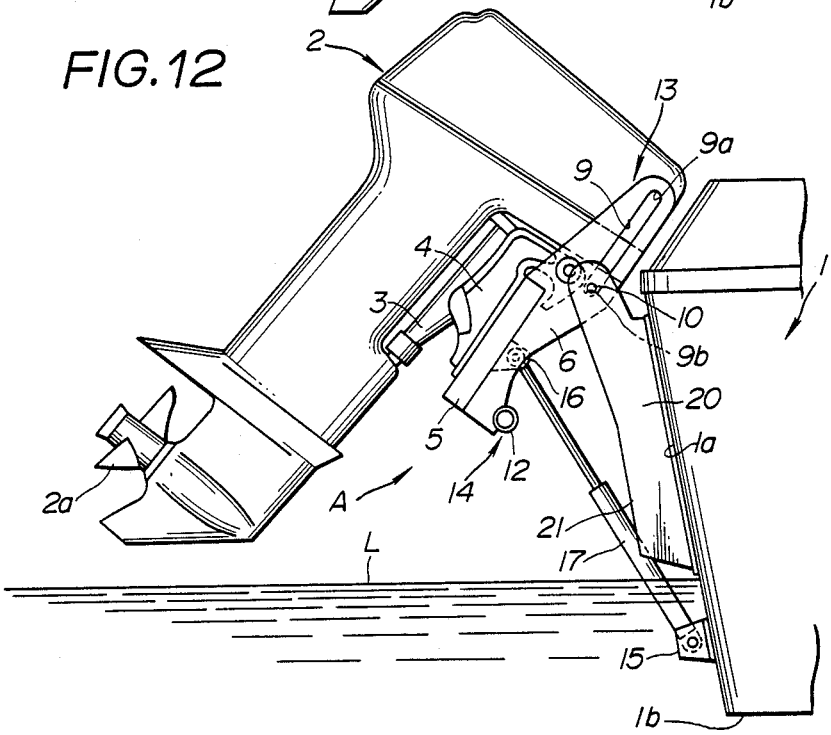

Further during kick-up of the propulsion unit 2, as shown in FIG. 10, the propulsion unit 2 is rotated around the guide rollers 10, 10 engaged with the upper terminals *9a, 9a* accompanied by extension of the tilt cylinder 17 whose relief valve is opened. During cruising of the boat 1 on the shoal, the tilt cylinder 17 is operated to extend as shown in FIG. 11 in which the propulsion unit 2 is raised until the guide rollers 10, 10 are brought into engagement with the lower terminals *9b, 9b* of the slits 9, 9, respectively. In this case, the propulsion unit 2 moves generally vertically since the slits 9, 9 and the guide rails 21, 21 extend generally vertically, so that the distance between the boat bransom *1a* and the propulsion unit 2 on the surface L of the water can be maintained generally constant regardless of the vertical positions of the propulsion unit 2. Furthermore in order to tilt up the propulsion unit 2, the tilt cylinder 17 is operated to be further extended over the state of FIG. 11, thereby causing the propulsion unit 2 to rotate clockwise around the guide rollers 10, 10 engaged respectively with the slit lower terminals *9b, 9b* as shown in FIG. 12. As a result, the propulsion unit 2 is raised over the surface L of the water.

Although each guide rail 21 and each thrust roller 12 have been shown and described as being installed to the side of the boat 1 and the side of the propulsion unit 2, respectively, in the second embodiment, it will understood that the guide rail 21 and the thrust roller 12 may be installed to the side of the propulsion unit 2 and the side of the boat 2, respectively, like in the first embodiment.

Figure 13:
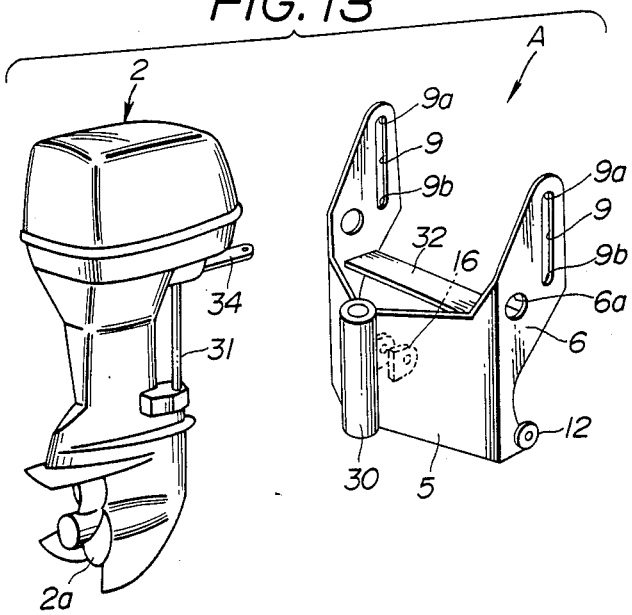
FIG. 13 is an exploded perspective view of a third embodiment of the outboard propulsion unit supporting system in accordance with the present invention.
Figure 14:
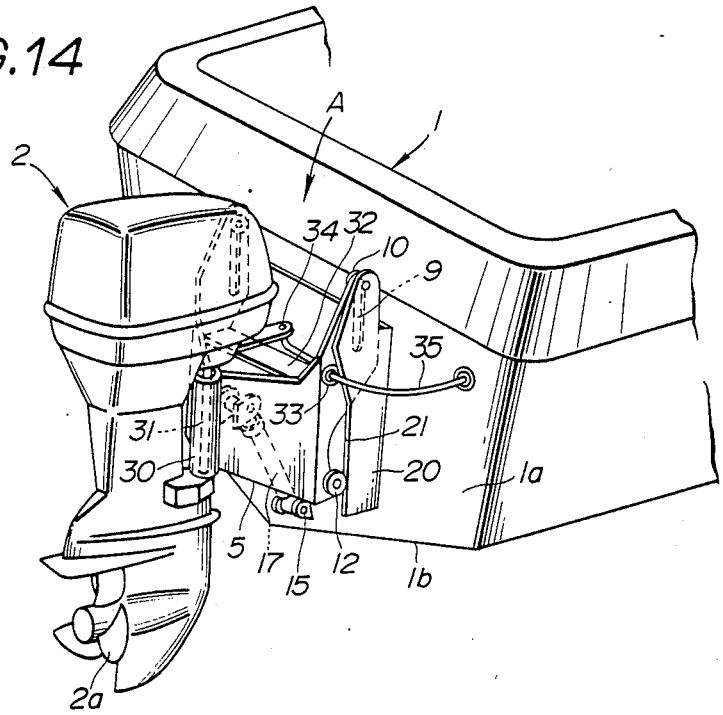
FIG. 14 is a perspective view of the supporting system of FIG. 13.

FIGS. 13 and 14 illustrate a third embodiment of the outboard propulsion unit supporting system A according to the present invention, similar to the second embodiment of FIGS. 8 and 9. In this embodiment, the support bracket 5 and the arm brackets 6, 6 are formed integral with each other. Additionally, the support bracket 5 is formed projecting rearwardly to have a vertical ridge section (no numeral) and have a generally V-shaped cross-section. A rudder shaft pipe 30 is fixedly secured to the ridge section of the support bracket 5 and directed vertically. The rudder shaft pipe 30 is rotatably disposed around a rudder shaft 31 of the propulsion unit 2. In other words, the rudder shaft 31 is journalled in the rudder shaft pipe 30. Additionally, a reinforcement plate 32 is provided to connect the opposite arm brackets 6, 6. Each arm bracket 6 is formed with a through-hole *6a* in which a cable mount 33 is securely fitted, so that a steering cable 35 for steering is passed through the cable mount 33 and connected to a tiller 34 projected from the propulsion unit 2.

Figure 15:
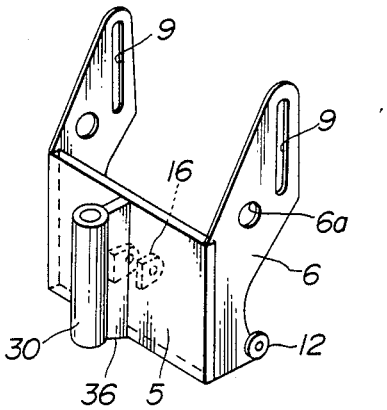
FIG. 15 is a perspective view of an essential part of a fourth embodiment of the outboard propulsion unit supporting system in accordance with the present invention.

FIG. 15 illustrates an essential part of a fourth embodiment of the outboard propulsion unit supporting system according to the present invention, similar to the third embodiment of FIGS. 13 and 14. In this embodiment, the arm brackets 6, 6 are fixedly secured to the opposite end reactions of the support bracket 5 like in the second embodiment of FIGS. 8 and 9. Additionally, the rudder shaft pipe 30 is fixedly secured through a vertically elongate bracket 36 to the support bracket 5 at the central part.

Figure 16:
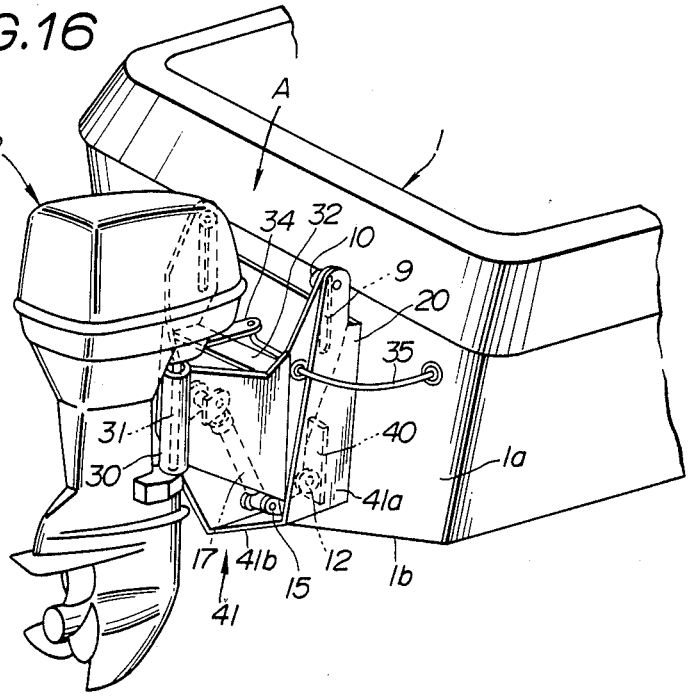
FIG. 16 is a perspective view of a fifth embodiment of the outboard propulsion unit supporting system in accordance with the present invention.

FIG. 16 illustrates a fifth embodiment of the outboard propulsion unit supporting system A in accordance with the present invention, similar to the third embodiment of FIGS. 13 and 14. In this embodiment, the guide rails 21, 21 for the thrust rollers 12, 12 are formed by providing a pair of plate members 40, 40 at the opposite inner surfaces of the transom brackets 20, 20, respectively. Each plate member 40 projects toward the opposite transom bracket 20 and extends generally vertically so that each guide rail 21 extends generally vertically. Thus, each thrust roller 12 is in detachable contact with the plate member 40 and movable generally vertically along the plate member 40. Additionally, each transom bracket 20 extends downwardly and rearwardly to form a deflector side plate section *41a*. The lower end of the opposite deflector side plate sections *41a, 41a* are integrally connected with a deflector bottom plate section *41b* which rearwardly extends from the boat bransom *1a* and has a V-shaped cross-section. The deflector side and bottom plate sections *41a, 41b* constitute a deflector 41 extending near the lower section front of the propulsion unit 2. The deflector 41 functions to regulate the direction of rearward water flow from the boat transom bottom so that the rearward water flow is effectively fed to the backside of the propulsion unit 2 without being impinging against the lower section front of the propulsion unit 2, thereby preventing generation of water spray to be sprinkled over the propulsion unit 2 and the boat 1.

While the guide rollers 10, 10 and the thrust rollers 12, 12 have been shown and described as being used respectively as movable members along the slits 9, 9 and the support members along the guide rails 7, 7 (21, 21; 40, 40) in the above-discussed embodiments, it will be appreciated that such movable and support members are not limited to roller type ones, so that the movable members are sufficient to be members which are movably engaged in the slits 9, 9, while the support members are sufficient to be members which are movable upon being brought into contact with the guide rails 7, 7 (21, 21; 40, 40).

What is claimed is:

1. An outboard propulsion unit supporting system for a boat, comprising:

first supporting means by which an outboard propulsion unit is supported to the boat, said first supporting means including means defining a slit extending generally vertically and having upper and lower terminals, and a movable member engaged in said slit, wherein one of said slit and said movable member is vertically movable with respect to the other;

second supporting means by which the propulsion unit is supported to the boat, said second supporting means including means forming a guide rail extending generally vertically, and a support member detachably contactable with said guide rail, wherein one of said guide rail and said support member is movable with respect to the other, and further wherein said movable member and said guide rail are in fixed relationship relative to one another, and wherein said slit and said support member are in a fixed relationship relative to one another; and a hydraulic cylinder whose whole length is changeable to move said propulsion unit relative to the boat, said hydraulic cylinder having a first end section pivotally connected to the side of the boat and a second end section pivotally connected to the side of the propulsion unit, said second end section being positioned upper and rear relative to said first end section.

2. An outboard propulsion unit supporting system for a boat, comprising:

first supporting means by which an outboard propulsion unit is supported to the boat, said first supporting means including means defining first and second slits which are located generally parallel with each other, each slit extending generally vertically and having upper and lower terminals, and first and second movable members, said first movable member being engaged in said first slit, and said second movable member being engaged in said second slit, wherein one of said slits and said movable members is vertically movable with respect to the other;

second supporting means by which the propulsion unit is supported to the boat, said second supporting means including means forming first and second guide rails which are located generally parallel with each other, each guide rail extending generally vertically, and first and second support members, said first support member being detachably contactable with said first guide rail, and said second support member being detachably contactable with said second guide rail, wherein one of said guide rails and said support members is movable with respect to the other, and further wherein said first and second movable members and said first and second guide rails are in a fixed relationship relative to one another, and wherein said first and second slits and said first and second support members are in a fixed relationship relative to one another; and a hydraulic cylinder whose whole length is changeable to move the propulsion unit relative to the boat, said hydraulic cylinder having a first end section pivotally connected to the side of the boat and a second end section pivotally connected to the side of the propulsion unit, said second end section being positioned upper and rear relative to said first end section.

3. An outboard propulsion unit supporting system as claimed in claim 2, wherein said slit defining means is secured to one of the propulsion unit side and the boat side, and said movable members are secured to the other of the propulsion unit side and the boat side.

4. An outboard propulsion unit supporting system as claimed in claim 3, wherein said guide rail forming means is secured to one of the propulsion unit side and the boat side, and said support members are secured to the other of the propulsion unit side and the boat side.

5. An outboard propulsion unit supporting system as claimed in claim 2, wherein each slit and each guide rail are substantially parallel with each other.

6. An outboard propulsion unit supporting system as claimed in claim 2, wherein said first and second slits are positioned opposite to each other with respect to extension of a vertical plane containing a longitudinal center axis of the boat.

7. An outboard propulsion unit supporting system as claimed in claim 6, wherein said first and second guide rails are positioned opposite to each other with respect to the extension of said vertical plane.

8. An outboard propulsion unit supporting system as claimed in claim 6, wherein said hydraulic cylinder is disposed such that its longitudinal axis is on said vertical plane.

9. An outboard propulsion unit supporting system as claimed in claim 2, wherein said first and second movable members are first and second rotatable rollers, respectively; and said first and second support members are third and fourth rollers, respectively.

10. An outboard propulsion unit supporting system as claimed in claim 2, wherein said first and second slit defining means includes first and second slit brackets which are fixedly secured to the boat side and formed with said first and second slits, respectively.

11. An outboard propulsion unit supporting system as claimed in claim 10, wherein said first and second movable members are first and second rollers, respectively, which are rotatably secured to the propulsion unit side.

12. An outboard propulsion unit supporting system as claimed in claim 2, wherein said first and second support members are third and fourth rollers, respectively, which are rotatably secured to the boat side.

13. An outboard propulsion unit supporting system as claimed in claim 12, wherein said first and second guide rails are formed on the propulsion unit side.

14. An outboard propulsion unit supporting system as claimed in claim 2, wherein said first and second slit defining means includes first and second arm brackets which are formed with said first and second slits, respectively, and fixedly secured to the propulsion unit side.

15. An outboard propulsion unit supporting system as claimed in claim 14, wherein said first and second movable members are first and second rollers, respectively, which are rotatably secured to the boat side.

16. An outboard propulsion unit supporting system as claimed in claim 2, wherein said first and second support members are third and fourth rollers, respectively, which are rotatably secured to the propulsion unit side.

17. An outboard propulsion unit supporting system as claimed in claim 16, wherein said first and second guide rails are formed on the boat side.

18. An outboard propulsion unit supporting system as claimed in claim 2, further comprising a support bracket to which a part of said second supporting means is securely connected, said support bracket being movably secured to the propulsion unit and provided with a member to which said hydraulic cylinder second end section is pivotally secured.

19. An outboard propulsion unit supporting system as claimed in claim 18, further comprising a cylindrical member which generally vertically extends and fixedly secured to said support bracket, said cylindrical member being rotatably mounted around a rudder shaft of the propulsion unit.

* * * * *